US007717359B2

(12) United States Patent
Sturman

(10) Patent No.: US 7,717,359 B2
(45) Date of Patent: May 18, 2010

(54) MULTIPLE INTENSIFIER INJECTORS WITH POSITIVE NEEDLE CONTROL AND METHODS OF INJECTION

(75) Inventor: Oded Eddie Sturman, Woodland Park, CO (US)

(73) Assignee: Sturman Digital Systems, LLC, Woodland Park, CO (US)

( * ) Notice: Subject to any disclaimer, the term of this patent is extended or adjusted under 35 U.S.C. 154(b) by 174 days.

(21) Appl. No.: 12/118,542

(22) Filed: May 9, 2008

(65) Prior Publication Data

US 2008/0277504 A1 Nov. 13, 2008

Related U.S. Application Data

(60) Provisional application No. 60/928,578, filed on May 9, 2007.

(51) Int. Cl.

| | |
|---|---|
| ***F02M 47/02*** | (2006.01) |
| ***F02M 45/10*** | (2006.01) |
| ***B05B 9/00*** | (2006.01) |
| ***F02M 57/02*** | (2006.01) |
| ***F02M 63/00*** | (2006.01) |

(52) U.S. Cl. ..... 239/88; 239/89; 239/93; 239/124; 239/125; 239/126; 123/446; 123/447

(58) Field of Classification Search ..... 239/88, 239/89, 93, 124–127; 123/299, 446, 447, 123/467, 468

See application file for complete search history.

(56) References Cited

U.S. PATENT DOCUMENTS

| | | | |
|---|---|---|---|
| 4,006,859 | A | 2/1977 | Thoma |
| 4,173,208 | A | 11/1979 | Fenne et al. |
| 4,627,571 | A | 12/1986 | Kato et al. |
| 4,821,689 | A | 4/1989 | Tittizer et al. |
| 4,856,713 | A | 8/1989 | Burnett |
| 5,108,070 | A | 4/1992 | Tominaga |
| 5,237,976 | A | 8/1993 | Lawrence et al. |

(Continued)

FOREIGN PATENT DOCUMENTS

| | | |
|---|---|---|
| JP | 61/008459 | 1/1986 |

(Continued)

OTHER PUBLICATIONS

"International Search Report and Written Opinion of the International Searching Authority Dated Aug. 21, 2008", International Application No. PCT/US2008/063321.

*Primary Examiner*—Dinh Q Nguyen
*Assistant Examiner*—Justin Jonaitis
(74) *Attorney, Agent, or Firm*—Blakely Sokoloff Taylor & Zafman LLP

(57) ABSTRACT

Multiple intensifier injectors with positive needle control and methods of injection that reduce injector energy consumption. The intensifiers are disposed about the axis of the injectors, leaving the center free for direct needle control down the center of the injector. Also disclosed is a boost system, increasing the needle closing velocity but without adding mass to the needle when finally closing. Direct needle control allows maintaining injection pressure on the fuel between injection events if the control system determines that enough fuel has been pressurized for the next injection, thus saving substantial energy when operating an engine at less than maximum power, by not venting and re-pressurizing on every injection event.

7 Claims, 3 Drawing Sheets

U.S. PATENT DOCUMENTS 5,419,492 A 5/1995 Gant et al.
5,421,521 A 6/1995 Gibson et al.
5,429,309 A 7/1995 Stockner
5,440,968 A 8/1995 Sekine
5,460,329 A * 10/1995 Sturman ..... 239/96
5,463,996 A 11/1995 Maley et al.
RE35,303 E 7/1996 Miller et al.
5,551,398 A 9/1996 Gibson et al.
5,638,781 A 6/1997 Sturman
5,640,987 A 6/1997 Sturman
5,641,121 A 6/1997 Beck et al.
5,669,355 A 9/1997 Gibson et al.
5,673,669 A 10/1997 Maley et al.
5,682,858 A 11/1997 Chen et al.
5,687,693 A 11/1997 Chen et al.
5,697,342 A 12/1997 Anderson et al.
5,713,316 A 2/1998 Sturman
5,738,075 A 4/1998 Chen et al.
5,752,659 A 5/1998 Moncelle
5,806,474 A 9/1998 Paul et al.
5,826,562 A 10/1998 Chen et al.
5,833,146 A 11/1998 Hefler
5,873,526 A 2/1999 Cooke
5,906,351 A 5/1999 Aardema et al.
5,950,931 A 9/1999 Beatty et al.
5,960,753 A 10/1999 Sturman
5,970,956 A 10/1999 Sturman
5,979,803 A 11/1999 Peters et al.
6,012,430 A 1/2000 Cooke
6,012,644 A 1/2000 Sturman et al.
6,026,785 A 2/2000 Zuo
6,047,899 A 4/2000 Graves
6,085,991 A 7/2000 Sturman
6,113,000 A 9/2000 Tian
6,119,960 A 9/2000 Graves
6,148,778 A 11/2000 Sturman
6,161,770 A 12/2000 Sturman
6,173,685 B1 1/2001 Sturman
6,257,499 B1 7/2001 Sturman
6,308,690 B1 10/2001 Sturman
6,360,728 B1 3/2002 Sturman
6,374,784 B1 4/2002 Tischer et al.
6,378,497 B1 4/2002 Keyster et al.
6,412,706 B1 7/2002 Guerrassi et al.
6,415,749 B1 7/2002 Sturman et al.
6,474,304 B1 11/2002 Lei
6,550,453 B1 4/2003 Tian
6,575,384 B2 6/2003 Ricco
6,592,050 B2 7/2003 Boecking
6,655,355 B2 12/2003 Kropp et al.
6,684,856 B2 2/2004 Tanabe et al.
6,684,857 B2 2/2004 Boecking
6,766,792 B2 7/2004 Messinger et al.
6,769,635 B2 8/2004 Stewart et al.
6,776,138 B2 8/2004 Mahr et al.
6,830,202 B2 12/2004 Coldren
6,868,831 B2 3/2005 Lei
6,910,462 B2 6/2005 Sun et al.
6,910,463 B2 6/2005 Oshizawa et al.
6,951,204 B2 10/2005 Shafer et al.
7,108,200 B2 9/2006 Sturman
7,278,593 B2 10/2007 Wang et al.
2002/0053340 A1 5/2002 Lei
2003/0155437 A1 8/2003 Lei
2003/0178508 A1 9/2003 Coldren
2004/0129255 A1 7/2004 Stuhldreher et al.
2004/0168673 A1 9/2004 Shinogle
2004/0188537 A1 9/2004 Sturman
2005/0092306 A1 5/2005 Shinogle et al.
2006/0032940 A1 2/2006 Boecking
2006/0157581 A1 7/2006 Kiss et al.
2006/0243253 A1 11/2006 Knight

FOREIGN PATENT DOCUMENTS

JP 61/096169 5/1986
WO WO-2006/008727 1/2006

* cited by examiner

MULTIPLE INTENSIFIER INJECTORS WITH POSITIVE NEEDLE CONTROL AND METHODS OF INJECTION

CROSS-REFERENCE TO RELATED APPLICATION

This application claims the benefit of U.S. Provisional Patent Application No. 60/928,578 filed May 9, 2007.

BACKGROUND OF THE INVENTION

1. Field of the Invention

The present invention relates to the field of fuel injectors.

2. Prior Art

Intensifier type fuel injectors are well known in the prior art. Such injectors use a larger first piston driven by a working fluid under pressure to drive a smaller piston to pressurize fuel for injection. Piston area ratios and thus intensification ratios typically on the order of 10 to 1 allow high injection pressures with only moderate pressure working fluid. Diesel fuel is fairly compressible at the applicable pressures. By way of example, diesel fuel compresses approximately 1% per 1000 psi. With injection pressures of 30,000 psi and higher, the compression of the fuel is substantial. The energy required for compression of the fuel not used for an injection event is generally wasted by the venting of the working fluid over the larger piston of the intensifier to a low pressure reservoir. Consequently, when an engine is running at substantially less than full power, a substantial part of the energy used for compression of a full injection charge is wasted.

Also in diesel fuel injectors, it is important to obtain a sharp start and stop of injection. A slow termination of injection, such as by a slowly decreasing injection pressure, results in poor atomization, or even no real atomization at the end of injection, resulting in incomplete combustion of the fuel, and unacceptable unburned hydrocarbon emissions.

DETAILED DESCRIPTION OF THE PREFERRED EMBODIMENTS

Figure 1:
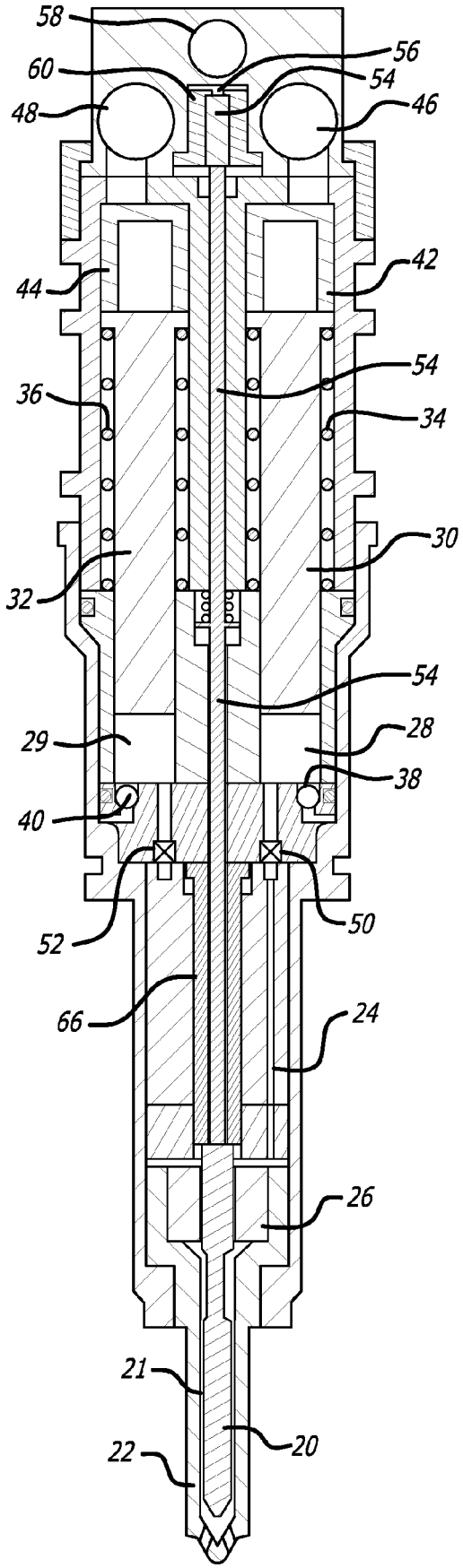
FIG. 1 is a cross section of one embodiment of the present invention.
Figure 2:
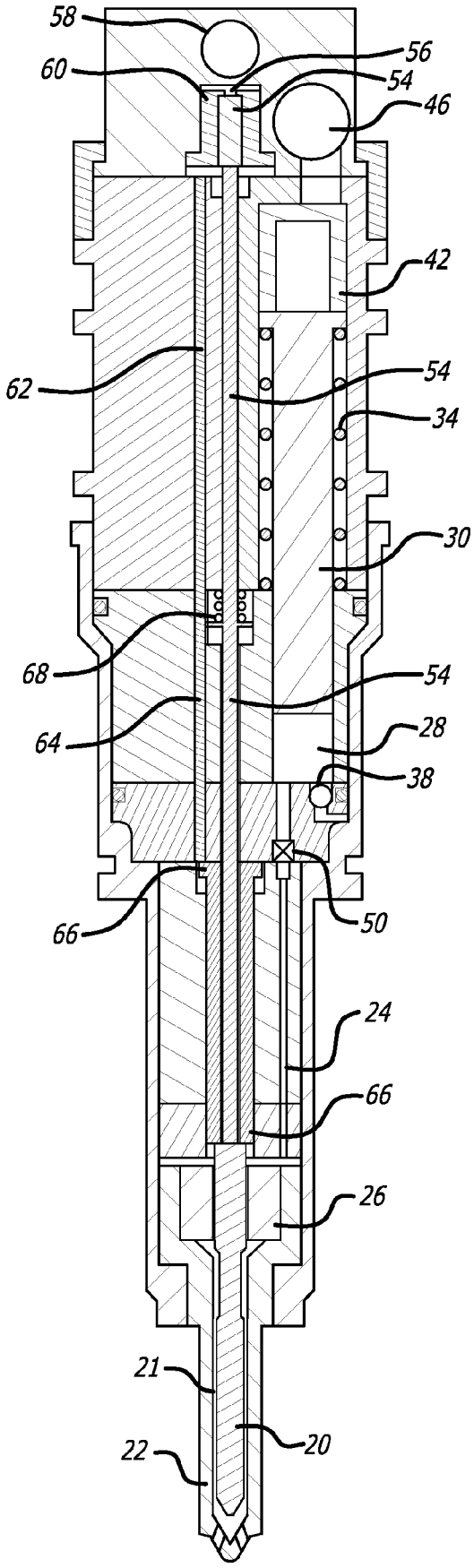
FIG. 2 is a cross section of the embodiment of FIG. 1 showing half sections taken 90 degrees apart.

FIGS. 1 and 2 illustrate an injector in accordance with the present invention. These Figures illustrate the injector in the needle open position, as during injection. FIG. 1 is a cross-section of an injector having two intensifiers, while FIG. 2 is a cross-section of the same injector illustrating the same cross-section on the right half of the Figure, though illustrating a cross-section ninety degrees therefrom on the left half of the Figure. In this injector, a needle 20 is provided which is almost pressure balanced so that when fuel at injection pressures is present in the needle chamber around the needle, there will be a relatively modest upward force on the needle.

Fuel is delivered to the needle chamber 21 in the injector tip 22 through port 24 and slots in member 26 from either or both intensifier chambers 28 and 29. The intensifier pistons 30 and 32 have spring returns 34 and 36 and are supplied with fuel on their return to the upper position through check valves 38 and 40. The intensifiers are powered by pistons 42 and 44, as controlled by control valves 46 and 48, respectively, preferably solenoid actuated spool valves. If fuel is being delivered to the needle chamber 21 by one intensifier only through the channel under the check valves and channels 24, then the other of check valves 50 and 52 will close, preventing the intensified pressure from being coupled to the non-operative intensifier.

The use of two intensifiers spaced radially outward from the center of the injector has the advantage of allowing direct needle control through the axis of the injector. In particular, member 54, which might be in one or more sections (more than one section being illustrated), extends all the way from the top of the needle 20 to a pressure chamber 56 at the top of the injector. Thus when actuation fluid control valve 58 applies pressure to the chamber 56, member 54 is hydraulically urged downward to close the needle by the actuation fluid pressure acting on the top piston area of member 54, the various parts in the preferred embodiment being proportioned to assure that the needle will positively close against intensified pressure in the needle chamber.

For initial needle closure, a boost system is used which assures rapid needle closure. In particular, the hydraulic pressure in chamber 56 also acts on the top of member 60, a boost piston which, as may be seen at the left side of FIG. 2, pushes down on pins 62, only one of the pins being shown in FIG. 2 as the other half of the cross-section is taken only ninety degrees therefrom. Pins 62 in turn push on pin 64 which pushes against member 66, which in turn pushes the needle 20 toward the closed position. However the bottom of member 66 will hit the top of member 26 before the needle finally closes, which substantially reduces the impact of needle closure, thereby allowing a very fast needle closure without risk of breaking the tip off of the needle chamber. Note that the stop for the boost assembly is relatively near the needle, minimizing the effects of differential expansion so that the boost may be repeatedly operative until just before needle closure. However the control valve 58 is located at the top of the injector, simplifying the electrical connections to the control valve. Also because all control valves, preferably solenoid actuated spool valves, are similarly located, actuation coils for all three valves may be printed on a multiplayer printed circuit board, further simplifying the electrical interconnection of components. Also the use to two intensifier assemblies allows use of smaller (faster) control valves.

By control of control valve 58, the needle 20 may be pushed downward to the closed position independent of the pressure in the needle chamber around the needle. Coil spring 68, a relatively light coil spring, merely assures that needle closure pin 54 remains at rest against the needle whether the needle is open or closed.

Thus to close the needle in the presence of intensified fuel, control valve 58 is open to provide fluid pressure in chamber 56, with pin 54 as well as the boost assembly just described, accelerating the needle toward the closed position, the boost being stopped just before the needle reaches the closed position to greatly reduce the inertia, and thus the impact on needle closure. In a preferred embodiment, the actuation fluid for the intensifier pistons 42 and 44 and for pin 54 and member 60 is engine oil, though other fluids such as fuel may be used if desired.

The advantages of using two intensifier assemblies as hereinbefore described are numerous. If the intensification ratios are different, then with a single actuation fluid pressure, two different injection pressures may be selectably obtained by operating one or the other intensifier. Two intensifier assemblies are still advantageous, even if they have the same intensification ratios. In particular, fuel injectors in general require a substantial amount of power. In the prior art, intensifiers are typically operated once for each injection and then depressurized to refill the intensifier chamber with fuel. Obviously the intensifier chamber must be large enough to intensify enough fuel for a single injection under the maximum requirements for the engine. Since injection pressures being used or desired to be used are 30,000 psi and higher, and fuel typically has a compressibility of approximately one percent per 1,000 psi, the fuel to be injected is compressed approximately twenty to thirty percent. In addition to compressing the fuel to be injected, there is also some overhead volume associated with the intensified fuel, including passages to get the intensified fuel to the needle chamber, and of course, the needle chamber itself. In the prior art, this full amount of energy required to pressurize fuel for maximum injection is used, independent of the engine operating conditions, even at engine idle.

In the present invention, however, at lighter engine loads where less fuel must be delivered to the combustion chamber, only a single intensifier assembly may be operated, thus essentially reducing the power required by the injector by fifty percent, assuming that not only are the intensification ratios the same, but also the intensifier pistons themselves are of the same diameter.

As an alternative, intensification ratios could be the same though one intensifier assembly could have twice the area, or twice the stroke (FIG. 3), or some combination of area and stroke differences to have twice the intensified fuel capacity of the other. Now when full injection is required, both intensifier assemblies could be used. When the engine is running at a lighter load only the larger intensification assembly might be used, and when running at a still lighter load, only the smaller intensification injection assembly may be used, thereby saving a very substantial amount of the energy otherwise required by injectors of the prior art.

Figure 3:
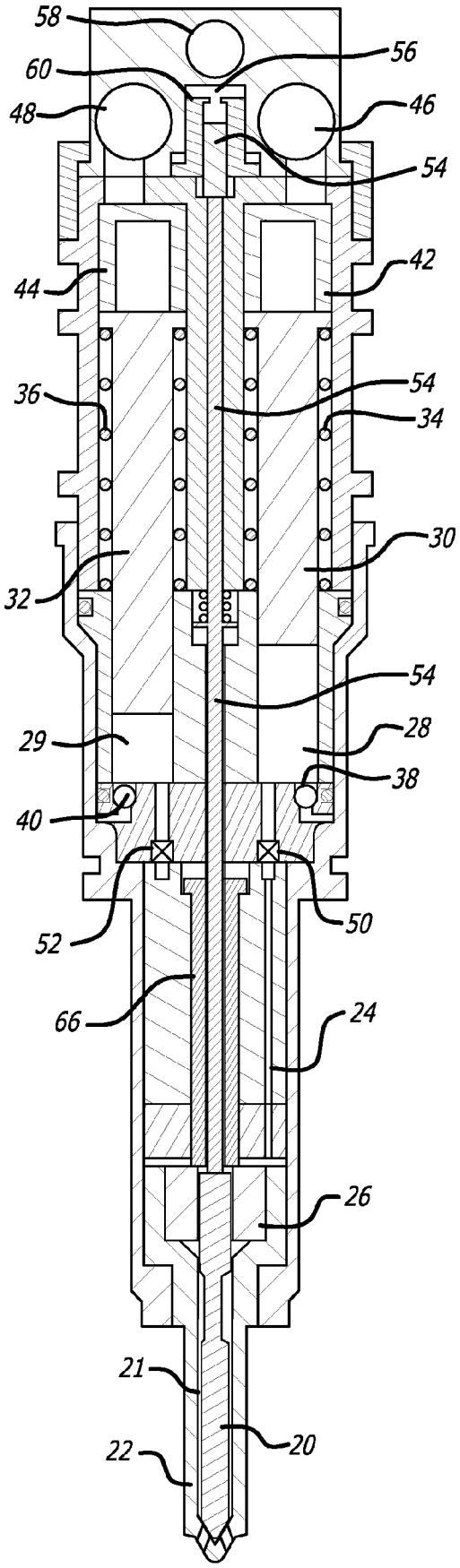
FIG. 3 is a cross section of another embodiment of the present invention.

Another way of operating injectors in accordance with the present invention, or even single intensifier assembly injectors having direct needle control, is as follows. First intensify at least as much fuel as required to at least meet the maximum injection requirements for a single injection event for that engine. (A single injection event may include, for example, a pre-injection, followed by a main injection.) However when the engine is operating under a lighter load, rather than depressurize and repressurize the intensifier assembly to depressurize and repressurize fuel for injection as is now done, simply maintain actuation fluid pressure over the intensifier, but control injection itself by control of the needle, such as, by way of example, is shown in FIGS. 1, 2 and 3.

Such operation can save a large fraction of the power required to operate the injector by simply intensifying once for multiple injections, the number of injections depending on the engine load and easily determined by the controller controlling the amount of fuel injected on each injection. For instance, using the present invention at idle, perhaps only one intensifier assembly need be operated with a single intensification providing six or more injections before needing to depressurize the intensifier to refill with fuel for intensification for subsequent injections. Thus the energy used in intensification may readily be made dependent on engine load conditions, and very substantially reduced as engine load is very substantially reduced. Thus while the prior art intensifies the maximum charge required for the engine, whether or not the maximum charge injection is required, the present invention may either intensify only the approximate amount of fuel needed for injection, or intensify a larger amount of fuel than needed for one injection, but maintain intensification for two or more injections, or both. The electronic control system for the injector valves may readily keep track of the amount of fuel injected on each injection to predict when re-intensification would be needed without requiring a feedback measurement. The electronic control may, by way of example, determine whether after an injection event, there remains enough intensified fuel for an equal injection event. If so, intensification is continued after the needle control closes the needle and the next injection event is executed through needle control, that injection event being limited to the amount of fuel at the intensified pressure that can be injected if the engine power setting has increased.

Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A fuel injector comprising:

an injector needle in a needle chamber;

first and second intensifiers;

first and second check valves configured to prevent either intensifier from intensifying fuel in the other intensifier;

first and second control valves for controllably coupling actuation fluid under pressure to the first and second intensifiers, respectively;

a needle control pin extending between the intensifiers to a top of the injector needle; and, a needle control valve for controllably coupling actuation fluid to an end of the needle control pin opposite the top of the injector needle, the injector needle and the needle control pin being proportioned to hold the needle closed when actuation fluid under pressure is coupled to the end of the needle control pin opposite the top of the injector needle and the needle chamber contains fuel at an intensified pressure.

2. The fuel injector of claim 1 further comprising a boost piston, the needle control valve also controllably coupling actuation fluid to the boost piston, the boost piston being coupled to encourage the needle from an open position toward a closed position, the boost piston being limited in motion to stop encouraging the needle toward the closed position as the needle approaches the closed position.

3. The fuel injector of claim 1 wherein the intensifiers are the same size.

4. The fuel injector of claim 1 wherein the intensifiers both have the same intensification ratio.

5. The fuel injector of claim 4 wherein the intensifiers have different intensified fuel capacities.

6. The fuel injector of claim 5 wherein the different intensified fuel capacities are the result, at least in part, of different areas of the intensifiers.

7. The fuel injector of claim 5 wherein the different intensified fuel capacities are the result, at least in part, of different strokes of the intensifiers.

* * * * *